US006240976B1

(12) United States Patent
Satoh et al.

(10) Patent No.: US 6,240,976 B1
(45) Date of Patent: Jun. 5, 2001

(54) PNEUMATIC TUCK-IN APPARATUS FOR SHUTTLELESS LOOM

(75) Inventors: Takeshi Satoh; Shigeharu Sawada, both of Ishikawa (JP)

(73) Assignee: Tsudakoma Kogyo Kabushiki Kaisha, Kanazawa (JP)

( * ) Notice: Subject to any disclaimer, the term of this patent is extended or adjusted under 35 U.S.C. 154(b) by 0 days.

(21) Appl. No.: 09/672,009

(22) Filed: Sep. 29, 2000

(30) Foreign Application Priority Data

Oct. 1, 1999 (JP) ..... 11-281434

(51) Int. Cl.[7] ..... D03D 47/48
(52) U.S. Cl. ..... 139/434
(58) Field of Search ..... 139/434

(56) References Cited

U.S. PATENT DOCUMENTS 2,267,287 * 12/1941 Moessinger ..... 139/434
4,715,410 * 12/1987 Griffith .
4,957,144 * 9/1990 Watanabe et al. ..... 139/434
4,984,608 * 1/1991 Bertsch et al. ..... 139/434
5,316,050 * 5/1994 Bertsch ..... 139/434

FOREIGN PATENT DOCUMENTS 1-174645 7/1989 (JP) .
6-16952 5/1994 (JP) .

* cited by examiner

*Primary Examiner*—Andy Falik
(74) *Attorney, Agent, or Firm*—Finnegan, Henderson, Farabow, Garrett & Dunner, L.L.P.

(57) ABSTRACT

A tuck-in apparatus for a shuttleless loom, for blowing an end portion of a weft into a shed, includes a plurality of nozzles located on a side of the row of warps for jetting air. The plurality of nozzles include: a tuck-in nozzle located in the vicinity of a cloth fell and oriented in substantially parallel with the cloth fell; and at least one auxiliary tuck-in nozzle oriented by an acute angle toward a warp supply side with respect to the cloth fell.

20 Claims, 9 Drawing Sheets

PNEUMATIC TUCK-IN APPARATUS FOR SHUTTLELESS LOOM

BACKGROUND OF THE INVENTION

1. Field of the Invention

The present invention relates to a tuck-in apparatus for a shuttleless loom, and more particularly, to an improved tuck-in apparatus for guiding the end portion of weft into a shed, by means of air squirted from a plurality of nozzles located on the side of the row of warps.

2. Description of the Related Art

In a tuck-in apparatus for a shuttleless loom, after a pick of weft, the end portion of the beaten-up weft is folded back into the next shed, to thereby form a selvage structure In a known tuck-in apparatus (described in, for example, Japanese Patent Unexamined Publication No.Hei.1-174645 and Japanese Utility Model Examined Publication No.Hei.6-16952), a tuck-in nozzles are disposed on the side of the row of warps and are directed to the row of warps, and the end portion of weft is blown into a shed by means of a jet of air squirted from the tuck-in nozzles.

In such a tuck-in apparatus of known type, the tuck-in nozzles are oriented in parallel with or toward a cloth fell.

In the case of a conventional tuck-in apparatus, the jet of air squirted from tuck-in nozzles acts on the end portion of weft (hereinafter referred to as "weft end") while being oriented in parallel with or toward a cloth fell. Immediately after release of the weft end, the weft end is folded back in the direction in which the air is squirted. As a result, loosening becomes likely to arise in the vicinity of an area where the thread of weft is to be folded back, or a portion of the weft end that has been folded back may interfere with a cloth fell, thereby rendering the fold of weft incomplete. Accordingly, there may arise defects in a woven fabric; for example, loosening or a fray arising in the vicinity of a selvage of a woven fabric.

Further, in the conventional tuck-in apparatus, the tuck-in nozzles are oriented toward an area which is close to a cloth-fell and at which a shed is narrow (hereinafter called a "narrow shed"). The weft end is blown into the narrow shed by means of the squirted air, and the weft end becomes readily caught by the warp, thereby resulting in occurrence of failures of salvage formation in a woven fabric.

Japanese Utility Model Examined Publication No.Hei.6-16952 describes a tuck-in apparatus, in which two tuck-in nozzles (i.e., a first tuck-in nozzle and a second tuck-in nozzle) are disposed side by side with each other along a warp line. The second tuck-in nozzle, which is positioned close to the cloth fell, is oriented toward a side from which the warps are supplied (hereinafter referred to simply as a "warp supply side") with respect to the cloth fell.

In such a tuck-in apparatus, the first tuck-in nozzle, which squirts the jet of air to the weft end before the second tuck-in nozzle does, is oriented toward a cloth fell and is liable to cause the same problem as that of the above-mentioned conventional tuck-in apparatus. Further, the tuck-in apparatus squirts the air simultaneously from the first and second tuck-in nozzles such that the jet of air squirted from the first tuck-in nozzle and the jet of air squirted from the second tuck-in nozzle cross each other. Consequently, the jet of air squirted toward the warp supply side is canceled, and the confluence of two jets is directed toward the cloth fell. For this reason, the tuck-in apparatus fails to solve the drawback of the conventional tuck-in apparatus, and the drawback still remains unsolved.

SUMMARY OF THE INVENTION

The present invention has been conceived to solve the drawback of the background art and is aimed at providing a tuck-in apparatus for a shuttleless loom, which folds back and blows the weft end into a shed, to thereby stably form a selvage, by means of a jet of air squirted from a nozzle disposed on the side of the row of warps while preventing occurrence of loosening in the vicinity of an area where the weft end is to be folded back, and occurrence of a failure, which would otherwise be caused during formation of a selvage when the weft is caught by the warp.

To this end, the present invention provides a tuck-in apparatus for a shuttleless loom, for blowing an end portion of a weft into a shed, including: a plurality of nozzles located on a side of the row of warps for jetting air, the plurality of nozzles including: a tuck-in nozzle located in the vicinity of a cloth fell and oriented in substantially parallel with the cloth fell; and at least one auxiliary tuck-in nozzle oriented by an acute angle toward a warp supply side with respect to the cloth fell.

The expression "in substantially parallel with" covers both the case where the tuck-in nozzle is disposed in parallel with the cloth fell and where the tuck-in nozzle is disposed to incline by a predetermined angle toward a cloth fell side or toward a warp supply side. In a case where the tuck-in nozzle is inclined toward the cloth fell side, the expression "a predetermined angle" means the range of inclination in which the jet of air from the tuck-in nozzle can sufficiently act on the tip end of the end portion of weft to be folded back. Alternatively, in a case where the tuck-in nozzle is inclined toward the warp supply side, the expression "a predetermined angle" means the range of inclination in which the end portion of weft is folded back such that the end portion of the weft is woven into a woven fabric in parallel with the cloth fell without the occurrence of a bend through a beating operation. More specifically, in a case where the tuck-in nozzle is excessively inclined toward the cloth fell side, the jet of air fails to sufficiently act on the tip end of the end portion of weft, which may cause the weft yarn to be woven while the tip end is bent. In a case where the tuck-in shuttle is excessively inclined toward the warp supply side, a large angle is formed between the end portion of the folded weft and the reed. The weft end becomes bent in association with beating action of the reed, which may in turn cause the weft yarn to be woven while the end portion of the weft is bent. Thus, the expression "a predetermined angle" means an angle at which the tuck-in nozzle is to be oriented with respect to the cloth fell so as not to-cause any of the foregoing problems.

Preferably, the auxiliary tuck-in nozzle is oriented such that the jet direction of the auxiliary tuck-in nozzle does not cross a jet direction of the tuck-in nozzle.

In a case where two or more auxiliary tuck-in nozzles are employed, the auxiliary tuck-in nozzles may be oriented such that jets of air squirted therefrom do not cross each other. Further, the two or more auxiliary tuck-in nozzles may be oriented at different angles with respect to the cloth fell, so as to form, with respect to the cloth fell, angles which are greater than that formed by the tuck-in nozzle with respect to the cloth fell, and may be caused to perform squirting action in sequence from the auxiliary tuck-in nozzle that squirts a jet of air at the largest angle with respect to the cloth fell.

By means of the previously-described configuration of the tuck-in apparatus according to the present invention, after the weft has been picked and beaten, the end portion of weft (called a "weft end") is guided from the range in which the weft end is susceptible to squirting action of an auxiliary tuck-in nozzle to the next shed while being blown toward a warp supply side, by means of the jet of air squirted by the auxiliary tuck-in nozzle. At this time, the weft end is driven toward the warp supply side from a folded portion in which a weft yarn is folded back, without the occurrence of loosening in the folded portion of the weft yarn. Further, the jet of air is squirted toward an area which is distant from a cloth fell and at which a large shed is formed. Accordingly, the weft end is blown into a shed without being caught by the threads of warp. Subsequently, the weft end is blown into the shed in substantially parallel with the cloth fell without involvement of any slack, by means of the jet of air squirted from the tuck-in nozzle. As a result, the weft end is folded back without being caught by the warp or without slack, thereby stably forming a selvage structure.

The auxiliary tuck-in nozzle is oriented such that the jet direction of the auxiliary tuck-in nozzle does not cross a jet direction of the tuck-in nozzle. As a result, there can be minimized the chance of the jet of air squirted from the auxiliary tuck-in nozzle affecting the jet of air squirted from the tuck-in nozzle. Consequently, the tuck-in nozzle can squirt air while the squirting action of the auxiliary tuck-in nozzle exerted on the weft end is maintained, whereby the weft end can be folded back without slack.

In a case where two or more auxiliary tuck-in nozzles are employed, the squirting action exerted on the weft end can be made stronger, thereby eliminating slack completely. So long as the auxiliary tuck-in nozzles are oriented such that the jet directions thereof do not cross each other, there can be reduced interference between the jets of air squired from the auxiliary tuck-in nozzles, to thereby enable stable feeding of the weft end toward the supply side.

In a case where a plurality of auxiliary tuck-in nozzles are employed, the auxiliary tuck-in nozzles are caused to perform squirting action in sequence from the auxiliary tuck-in nozzle having a largest angle with respect to the cloth fell; that is, in sequence from the auxiliary tuck-in nozzle that squirts a jet of air to a tip end of the weft end. As a result, the weft end is blown sequentially from the tip end thereof without involvement of instability, thereby enabling stable formation of a selvage structure.

DETAILED DESCRIPTION OF THE PREFERRED EMBODIMENTS

Preferred embodiments of the present invention will be described hereinbelow by reference to the accompanying drawings.

Figure 1:
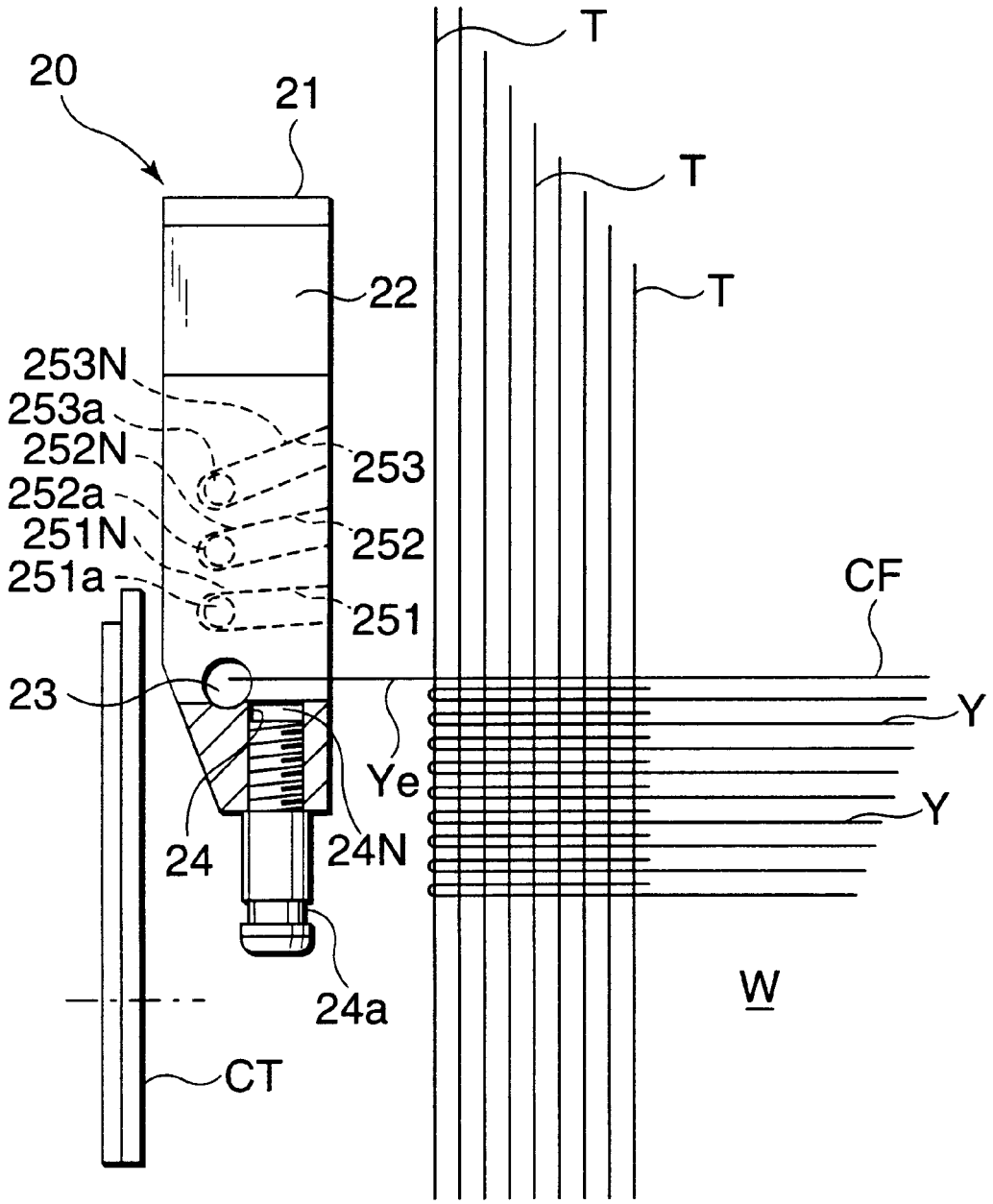
FIG. 1 is a fragmentary plan view showing a tuck-in apparatus according to an embodiment of the present invention.
Figure 2:
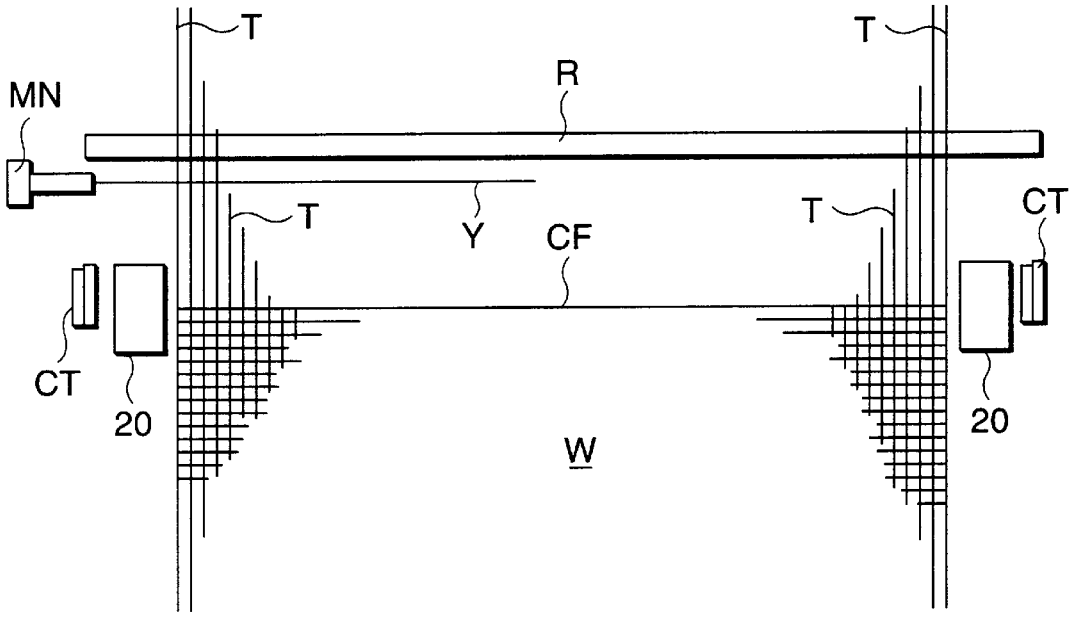
FIG. 2 is a schematic plan view showing an example shuttleless loom equipped with the tuck-in apparatus according to the present invention.

FIGS. 1 through 5 show a tuck-in apparatus for a shuttleless loom according to one embodiment of the present invention. A tuck-in apparatus 20 is disposed on each side of the row of warps T set in a shuttleless loom 10. A cutter CT is disposed adjacent to the tuck-in apparatus 20 such that an extension of a cloth fell CF crosses the tuck-in apparatus 20 and the cutter CT (FIGS. 1 and 2).

The shuttleless loom 10 comprises a picking nozzle MN for inserting a weft yarn Y into an opening formed between the warps (T, T, . . . ) (hereinafter simply called a "shed"), and a reed R for beating the weft yarn Y, which has been picked by the picking nozzle MN, against the cloth fell CF, to thereby form a woven fabric W. In an illustrated embodiment, the picking nozzle MN is mounted on an unillustrated reed holder, which supports the reed R and swingingly moves back and forth (i.e., in a vertical direction in the drawing), and is swingingly moved back and forth together with the reed R when the reed R performs a beating operation by utilization of swinging motion of the reed holder.

A pair of cutters CT are provided on both sides of the shuttleless loom 10; that is, one being provided on an insertion side of the shuttleless loom 10 and the other being provided on the remaining side of the same. Each of the cutters CT is disposed on the side of the tuck-in apparatus 20, which side does not oppose the row of warp T. After the weft yarn Y picked by the picking nozzle MN has been beaten against the cloth fell CF, an end potion Ye of the weft yarn Y projecting from the row of warps T is cut into a predetermined length by the cutter CT.

The tuck-in apparatus 20 is primarily formed from a nozzle block 21 made of a thick block member. A slit 22, a capturing hole 23, a release hole 24, and guide holes 251, 252, and 253 are formed in the nozzle block 21 (see FIGS. 1 and 3).

Figure 3:
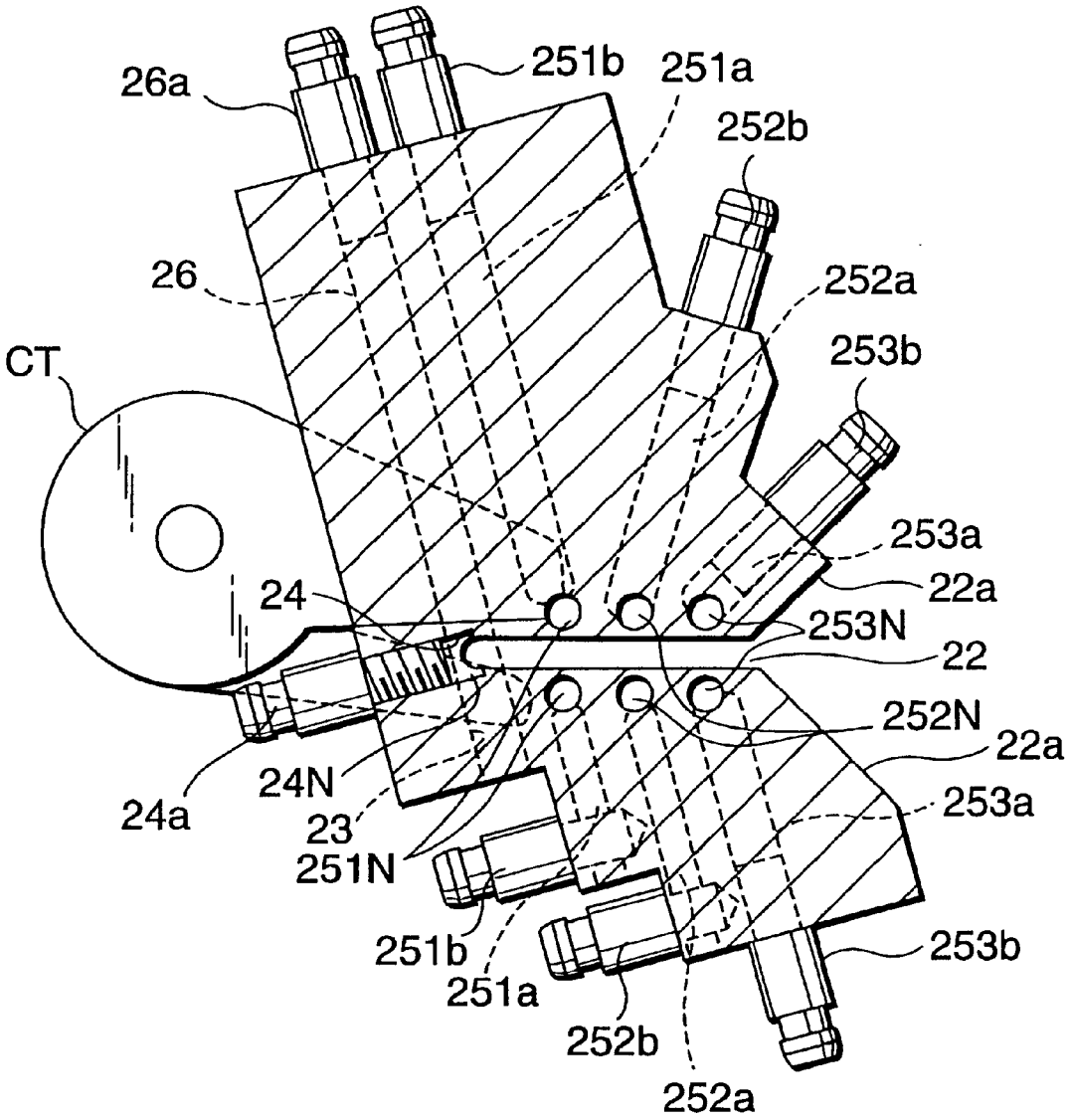
FIG. 3 is a longitudinal cross section showing the tuck-in apparatus according to the embodiment.

The slit 22 is opened toward three directions; i.e., a warp supply side, a side of the warps T, and a side of the cutter CT. As shown in FIG. 3, guide surfaces 22*a* are formed in the front end of the slit 22, which faces the warp supply side.

The capturing hole 23 captures the end potion Ye of weft introduced into the slit 22 in the vicinity of the front side. The capturing hole 23 is formed at a deep position of the slit 22 so as to be oriented downwardly. A air passage 26 which is identical in diameter with the capturing hole 23 is disposed opposite the capturing hole 23, with the slit 22 interposed therebetween, such that the air passage 26 is in communication with the capturing hole 23. A nipple 26*a* is screwed into one end of the air passage 26. The air passage 26 is connected to an unillustrated air supply by way of the nipple 26*a*. Accordingly, air supplied from the air supply can be introduced into the capturing hole 23 by way of the nipple 26*a* and the air passage 26.

The release hole 24 acts as a release nozzle 24N which releases the end portion Ye of the captured weft from the capturing hole 23, to thereby guide the end portion Ye toward the front end of the slit 22. The release hole 24 is formed at a bottom position in the slit 22, which is more close to the row of warps T than the capturing hole 23. Another nipple 24*a* connected to the air supply is screwed into the release hole 24, to thereby enable introduction of air supplied from the air supply to the release hole 24 by way of the nipple 24*a*.

The guide holes 251, 252, and 253 act as tuck-in nozzles and auxiliary tuck-in nozzles for guiding the end portion Ye of weft into the shed. In FIG. 3, the guide holes 251 located closest to the cloth fell CF act as tuck-in nozzles 251N, and the guide holes 252 and 253 act as auxiliary tuck-in nozzles 252N and 253N.

The guide holes 251, 252, and 253 are provided on both sides to interpose the slit 22 and extend in parallel therewith toward the cutter CT. The guide holes 252, 252, and 253 are formed to open in a side of the nozzle block 21, which faces the row of warps T. Each of the guide holes 251 is connected to the air supply by way of an air passage 251*a* and a nipple 251*b*; each of the guide holes 252 is connected to the air supply by way of an air passage 251*b* and a nipple 252*a* and a nipple 252*b*; and each of the guide holes 253 is connected to the air supply by way of an air passage 253*a* and a nipple 253*b*.

Although the guide holes 251, 252, and 253 are formed in parallel with the slit 22, the guide holes may be formed obliquely in the thicknesswise direction of the slit 21 so as to be directed to a plane in parallel with the woven fabric W including a warp line WL. Further, although in this embodiment, the guide holes 251, 252, and 253 are provided on both sides of the slit 22, they may be provided on one side of the slit 22.

Figure 5:
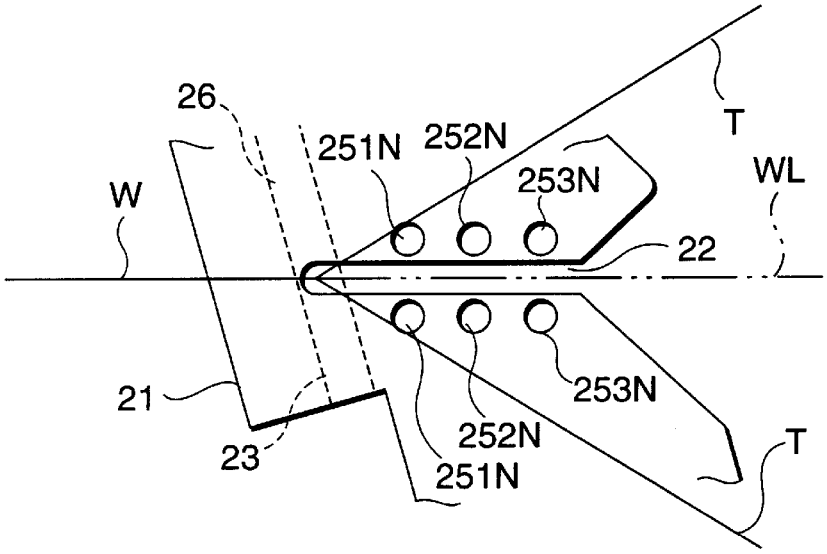
FIG. 5 is an enlarged side view showing the principal section of the tuck-in apparatus according to the embodiment.

The nozzle block 21 is positioned between the cutter CT and the row of warps T such that the capturing hole 23 formed in the deep location of the slit 22 is situated in an extension of the cloth fell CF and such that the slit 22 becomes substantially parallel with the warp line WL (see FIGS. 1 and 5). At this time, an opening formed between the guide surfaces 22*a* and 22*a* faces the warp supply side, and the guide holes 251, 252, and 253 fall within the range of a shed formed between the warps T.

In such a tuck-in apparatus 20 according to the present invention, the auxiliary tuck-in nozzles 252N and 253N are formed so as to be directed toward the warp supply side and form acute angles with respect to the cloth fell CF.

Figure 4:
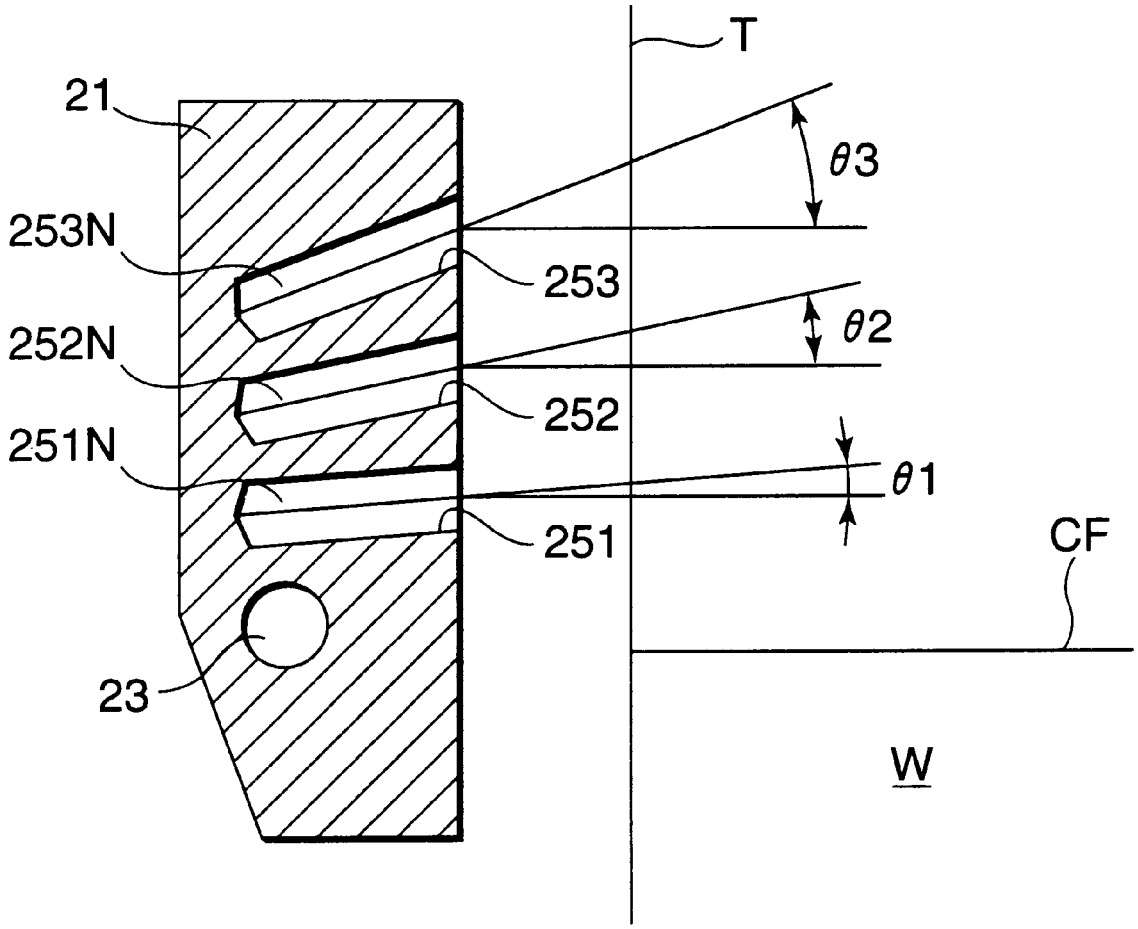
FIG. 4 is a plan view showing the cross section of the principal section of the tuck-in apparatus according to the embodiment.

As shown in FIG. 4, in the present embodiment, angles θ2 and θ3 respectively formed by the auxiliary tuck-in nozzles 252N and 253N with respect to the cloth fell CF are set so as to become greater than angle θ1 formed by the tuck-in nozzle 251N with respect to the cloth fell CF (i.e., θ2>θ1 and θ3>θ1). The tuck-in nozzle 251N forms the angle θ1 with respect to the cloth fell CF with the range of a predetermined inclination, and is directed toward the warp supply side. Here, the tuck-in. nozzle 251N may be oriented in parallel with the cloth fell CF. So long as the angle θ1 falls within the range of certain inclination, the tuck-in nozzle 251N may be directed toward the cloth fell CF.

In this embodiment, the angle θ3 formed by the auxiliary tuck-in nozzle 253N with respect to the cloth fell CF is set so as to become greater than the angle θ2 formed by the auxiliary tuck-in nozzle 252N with respect to the cloth fell CF (θ3>θ2), that is, the auxiliary tuck-in nozzles 252N and 253N are disposed to prevent two axes of jet directions of the auxiliary tuck-in nozzles 252N and 253N from intersecting in the side of the row of the warps T (see FIG. 4). However, the angle θ2 may be equal to the angle θ3 (θ2=θ3). Even in such a case, there is prevented occurrence of intersect in the side of the row of the warps T between the two axes of the jet directions of the auxiliary tuck-in nozzles 252N and 253N.

Figure 6:
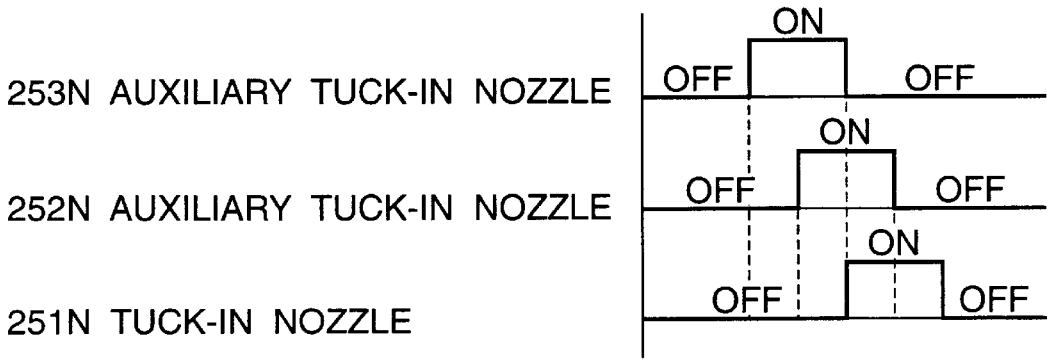
FIG. 6 is a timing chart showing timings at which squirting action is to be performed by the tuck-in apparatus according to the embodiment.

In addition, in this embodiment, as shown in FIG. 6, the tuck-in nozzle 251N, the auxiliary tuck-in nozzles 252N and 253N squirt air in sequence from the auxiliary tuck-in nozzle 253N having a largest angle with respect to the cloth fell.

The operation of the tuck-in apparatus 20 of the shuttleless loom 10 having the foregoing configuration will now be described by reference to FIGS. 7A through 7E. Although a description will be given of only the tuck-in apparatus 20 provided on a yarn-feeding side of the loom 10, the same applies to the tuck-in apparatus 20 provided on the other side of the loom 10.

The weft warn Y picked by the picking nozzle MN is brought to a side of the cloth fell CF by the reed R and is beaten against the cloth fell CF by means of a beating operation of the reed R. During the course of these operations, the end portion Ye extending from the picking nozzle MN to the row of warps T is introduced into the slit 22 by way of one of the guide surfaces 22*a*, and the thus-introduced end portion Ye reaches a deep position of the slit 22 by means of a beating action (see FIG. 7A). At this time, the end portion Ye extends substantially linearly across the cutter CT and the slit 22 and reaches the capturing hole 23 formed at the deep position in the slit 22.

After beating of the weft yarn Y, the cutter CT is activated to cut the end portion Ye, such that the thus-cut end of the end potion Ye located in the vicinity of the picking nozzle MN constitutes a free end. When air is supplied to the capturing hole 23, the free end of the end portion Ye is captured by the capturing hole 23 by means of air.

After the weft yarn Y located in the cloth fell CF has been restrained by means of an opening action of the warps T, the supply of air to the capturing hole 23 is stopped, and air is supplied to the release nozzle 24N. Air is squirted from the release nozzle 24N toward the front side of the slit 22 (see FIG. 7B). Thus, the end portion Ye is draw out from the capturing hole 23 and is blown in the forward of the slit 22. The end portion Ye of weft is bent to the warp supply side at a point where the cloth fell CF is folded back (hereinafter referred to as "turning point"). The thus-returned end portion Ye is blown into the area in which the end portion Ye is susceptible to squirting operations of the auxiliary tuck-in nozzles 252N and 235N and the tuck-in nozzle 251N.

First, air is supplied to the auxiliary tuck-in nozzle 253N, and the auxiliary tuck-in nozzle 253N squirts air toward a shed subsequent to the shed in which the weft yarn Y has already been inserted (see FIG. 6C). At this time, the jet of air squired from the auxiliary tuck-in nozzle 253N acts on the tip end of the end portion Ye at the angle θ3 that is the largest angle with respect to the cloth fell CF. The end portion Ye is blown into the shed while being blown toward the warp supply side at the direction of angle θ3.

Figure 7A:
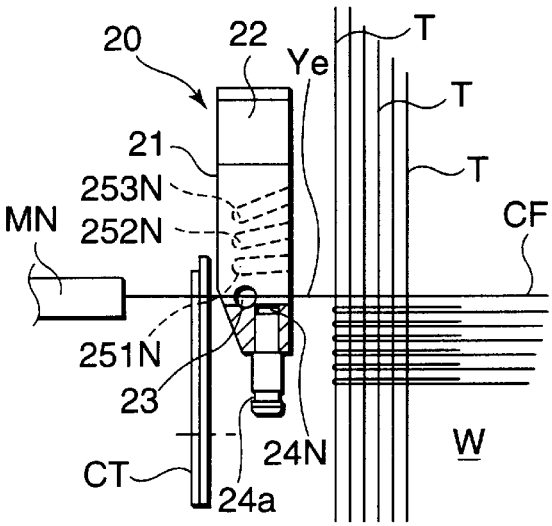
FIGS. 7A through 7E are descriptive views for describing the operation of the tuck-in apparatus according to the embodiment.
Figure 7B:
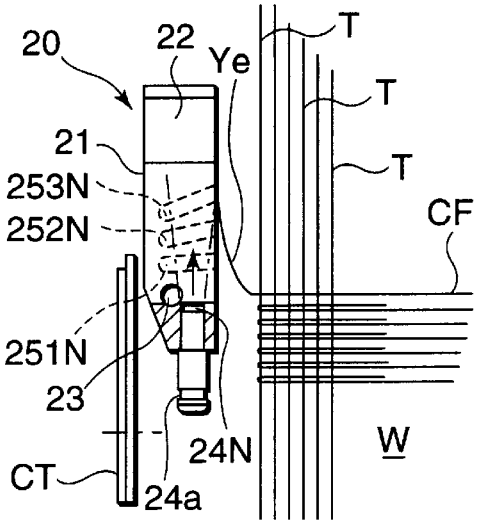
Figure 7C:
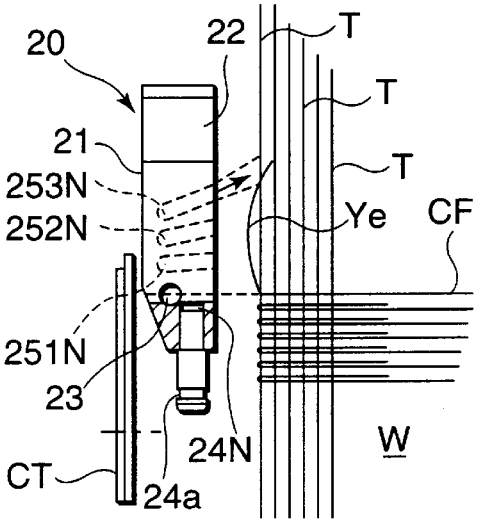
Figure 7D:
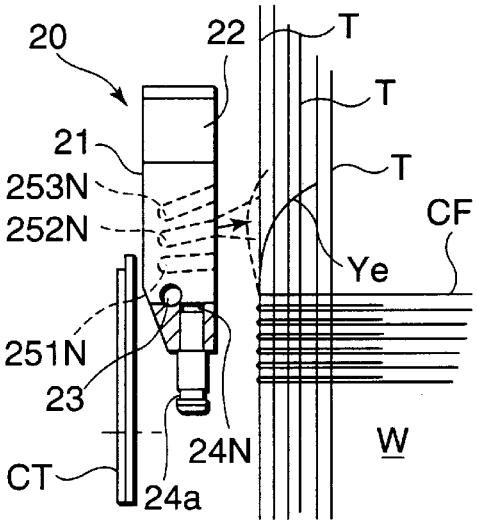

Next, air is supplied to the auxiliary tuck-in nozzle 252N while the squirting of air from the auxiliary tuck-in nozzle 253N is continued, and the auxiliary tuck-in nozzle 252N starts squirting air (see FIG. 7D). The auxiliary tuck-in nozzle 253N stops squirting action at a predetermined timing shown in FIG. 6 after squirting action of the auxiliary tuck-in nozzle 252N has been commenced. As a result, the end portion Ye of weft is guided toward the cloth fell CF at the angle θ2. The weft yarn Y is bent toward the cloth fell CF while being driven toward the warp supply side at the direction of angle θ2.

As mentioned above, the end portion Ye of weft is blown into the shed while being driven toward the warp supply side by means of the auxiliary tuck-in nozzles 252N and 253N. Accordingly, the weft yarn Y is folded back to the shed without the occurrence of loosening at the turning point.

Further, the auxiliary tuck-in nozzles 252N and 253N perform squirting action in sequence from the auxiliary tuck-in nozzle 253N that squirts air to the position closest to the tip end of the end portion Ye of weft. Consequently, the end portion Ye of weft is blown into the shed in a stretched manner without the occurrence of a bend in an intermediate portion of the end portion Ye. The end portion Ye is brought close to the cloth fell CF without the occurrence of a slack in an intermediate portion or a bend in the tip end of the end portion Ye.

Figure 7E:
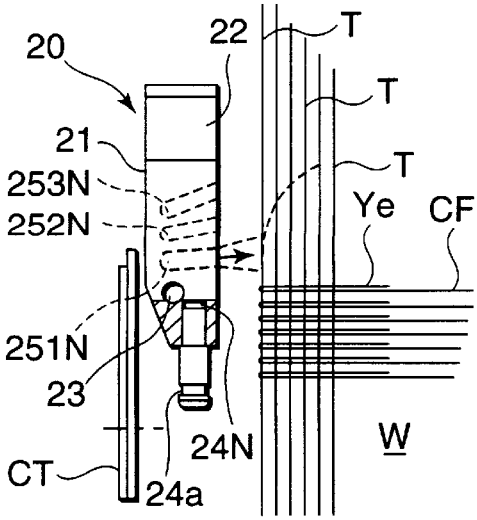

Subsequently, air is supplied to the tuck-in nozzle 251N while the squirting of air from the auxiliary tuck-in nozzle 252N is continued, and air is squired from the tuck-in nozzle 251N (see FIG. 7E). Here, the squirting action of the auxiliary tuck-in nozzle 252N is stopped at a predetermined timing shown in FIG. 6 after squirting action of the tuck-in nozzle 251N has commenced. Consequently, the end portion Ye of weft is folded back in substantially parallel with the cloth fell CF, in a stretched manner without involvement of slack in the turning point. Through insertion of the next weft yearn Y and beating operation of the reed R, the weft yarn Y is woven into the woven fabric W, thus forming a sturdy selvage structure.

The present invention is not limited the above embodiment and may be susceptible to various modifications within the scope of the invention. A description will be given of a part of the modifications of the above embodiment.

(i) Although the foregoing embodiment has described the tuck-in apparatus 20 having the two auxiliary tuck-in nozzles 252N and 253N, the present invention is not limited to such an embodiment. With at least one auxiliary tuck-in nozzle, the object of the invention is attained.

Figure 8:
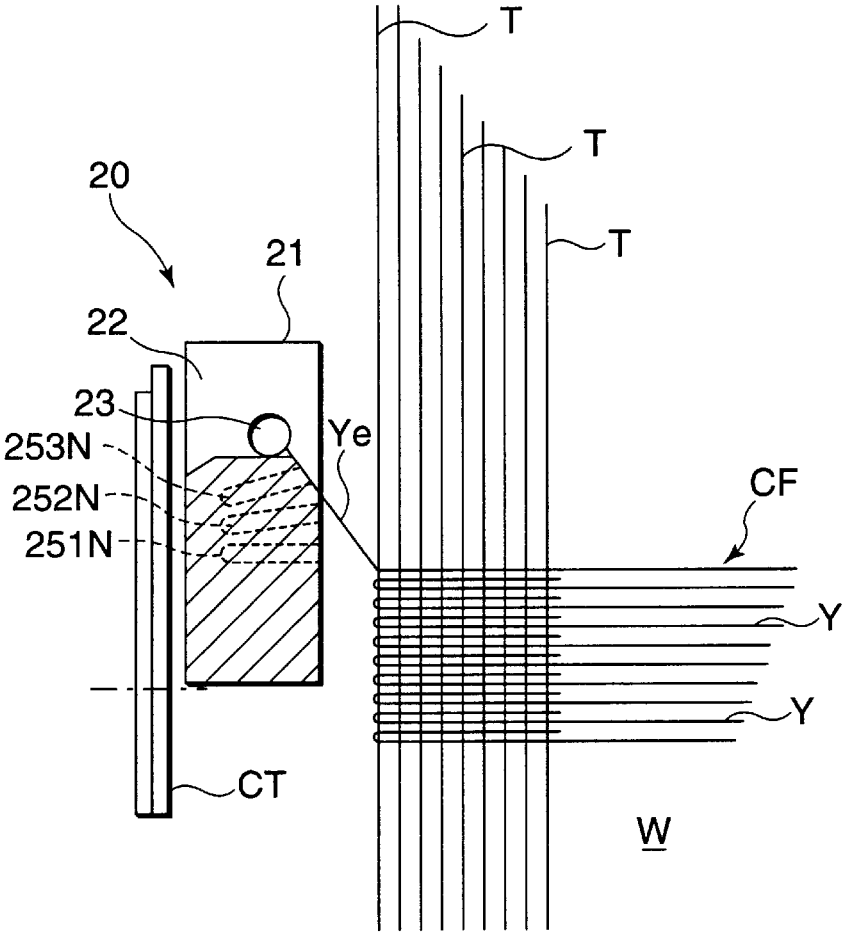
FIG. 8 is a fragmentary plan view showing a tuck-in apparatus according to another embodiment of the present invention.

(ii) Further, the foregoing embodiment has described the case where the tuck-in nozzles 251N and the auxiliary tuck-in nozzles 252N and 253N are provided forward of the capturing hole 23 (i.e., at positions closer to the warp supply side than the position of the capturing hole 23) and where the tuck-in nozzles 251N and the auxiliary tuck-in nozzles 252N and 253N are respectively provided in the upper and lower sides of the slit 22 to interpose the slit 22. For example, as shown in FIG. 8, the tuck-in nozzle 251N and the auxiliary tuck-in nozzles 252N and 253N may be provided backward of the capturing hole 23 that is provided at a deep position in the slit 22, and to be flush with the slit 22.

In this case, as shown in the drawing, the capturing hole 23 of the tuck-in apparatus 20 is located closer to the warp supply side than to the cloth fell CF. The end portion Ye has already been captured by the capturing hole 23 and is situated in the area in which the end portion Ye is susceptible to the operating action of the tuck-in nozzle 251N and that of the auxiliary tuck-in nozzles 252N and 253N. Hence, the release nozzle 24N cannot be omitted.

Figure 9:
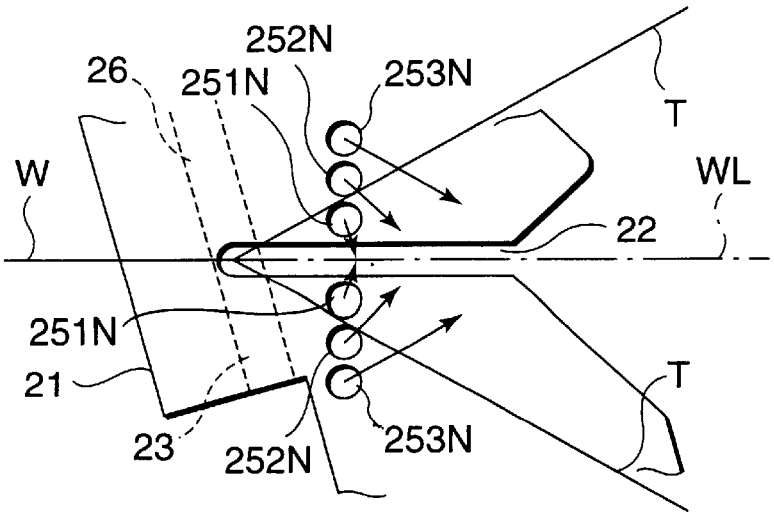
FIG. 9 is an enlarged side view showing the principal section of the tuck-in apparatus according to another embodiment.

(iii) There is no necessity of limiting tuck-in nozzle 251N and the auxiliary tuck-in nozzles 252N and 253N to the layout described in the foregoing embodiment; that is, they are juxtaposed on either side of the slit in parallel with the warp line WL. On the other hand, as shown in FIG. 9, they may be arranged into a row along a direction perpendicular to the warp line WL. In this case, the nozzles located closest to the slit 22 are preferably taken as tuck-in nozzles 251N. Further, the nozzles may be oriented in the same direction as in the foregoing embodiment. In this case, since the auxiliary tuck-in nozzles 252N and 253N are located remote from the slit 22, they are preferably provided at angles so as to be oriented toward the warp line WL.

Figure 10A:
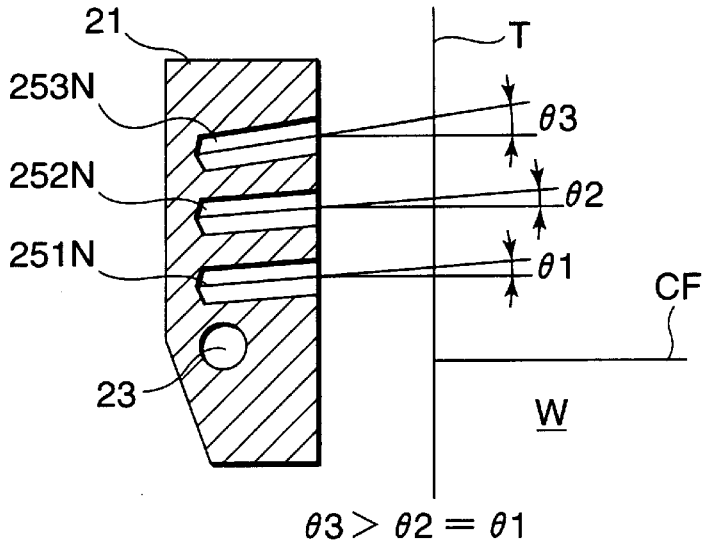
FIGS. 10A through 10C are plan views showing the cross section of the principal section of the tuck-in apparatus according to another embodiment.
Figure 10B:
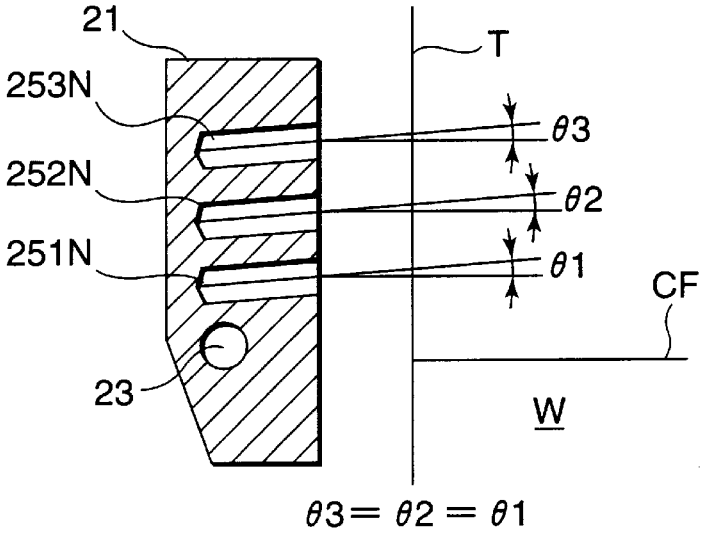

(iv) Further, there is no necessity of directing the auxiliary tuck-in nozzles 252N and 253N toward the warp supply side so as to form, with respect to the cloth fell CF, angles greater than that formed by the tuck-in nozzle 251N with respect to the cloth fell CF. In a case where the tuck-in nozzle 251N is directed toward the warp supply side, either one of or both the auxiliary tuck-in nozzles 252N and 253N, for example, may be directed toward the cloth fell CF at the same angle as that at which the tuck-in nozzle 251N is directed toward the cloth fell CF, as shown in FIGS. 10A, 10B, and 10C.

In the present invention, so long as auxiliary tuck-in nozzles are directed toward a warp supply side at an acute angle, the angle may assume any value. The angle may be determined appropriately, in view of a jet of air acting on an end portion of weft.

Figure 10C:
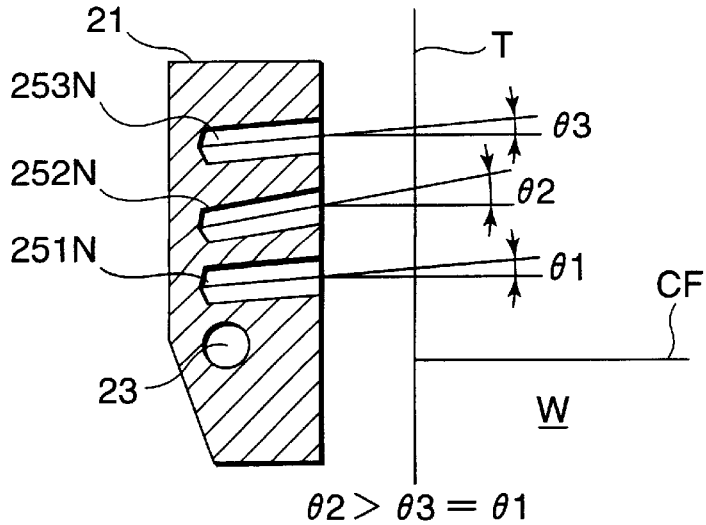

In a case shown in FIG. 10C, the axis of the jet direction of the auxiliary tuck-in 252N crosses that of the auxiliary tuck-in 253N in the side of the row of warps T. In this way, depending on the directions in which auxiliary tuck-in nozzles and a tuck-in nozzles are oriented, the axes of the jet directions between auxiliary tuck-in nozzles or between an auxiliary tuck-in nozzle and a tuck-in nozzle may be intersected, whereby the jets of each air may interfere with each other and affect squirting directions. Even in such a case, unless interference between the jets of air adversely affects the fold of an end portion of weft or one jet of air affects another jet of air because of a difference in squirting timings of the two jets of air, there is no need to change the layout of the auxiliary tuck-in nozzles or the layout of the tuck-in nozzle.

Figure 11:
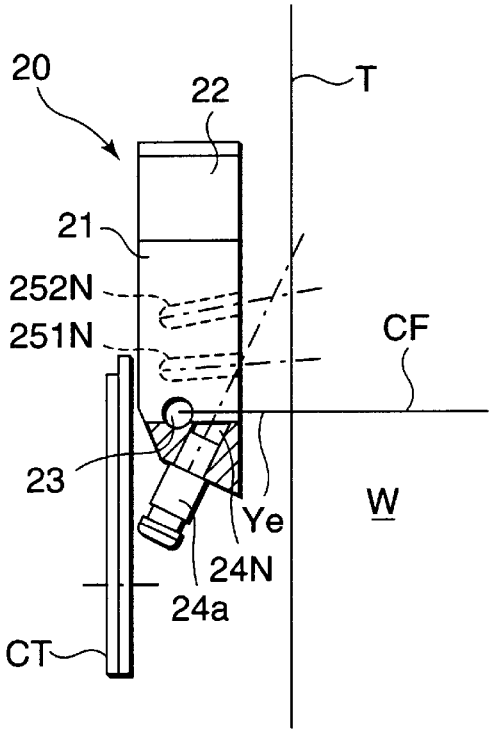
FIG. 11 is a fragmentary plan view showing a tuck-in apparatus according to another embodiment.

(v) In the foregoing embodiment, the release nozzle 24N is directed in parallel with the row of warps T, releases the end portion Ye of weft from the capturing hole 23, and brings the end portion Ye to the area in which the end portion Ye is susceptible to the action of the auxiliary tuck-in nozzles. However, as shown in FIG. 11, the release nozzle 24N may be oriented at an angle toward the row of warps T and additionally imparted with the function of guiding the end portion Ye into a shed. The release nozzle 24N thus structured acts as an auxiliary tuck-in nozzle employed in the present invention.

(vi) There is no necessity of causing a plurality of auxiliary tuck-in nozzles to sequentially perform squirting action, as in the case of the foregoing embodiment. A plurality of auxiliary tuck-in nozzles may be caused to squirt simultaneously. Further, there is no necessity of causing auxiliary tuck-in nozzles to perform squirting action prior to the squirting action of a tuck-in nozzle. For example, as shown in FIG. 8, in a case where the squirting action of the auxiliary tuck-in nozzles is operated prior to that of the tuck-in nozzles because of the positional relationship between the end portion Ye of weft and the auxiliary tuck-in nozzles (that is, the- auxiliary tuck-in nozzles are close to the end portion Ye of weft in comparison with the tuck-in nozzle), the auxiliary tuck-in nozzles may be caused to squirt simultaneously with the tuck-in nozzle.

Figure 12:
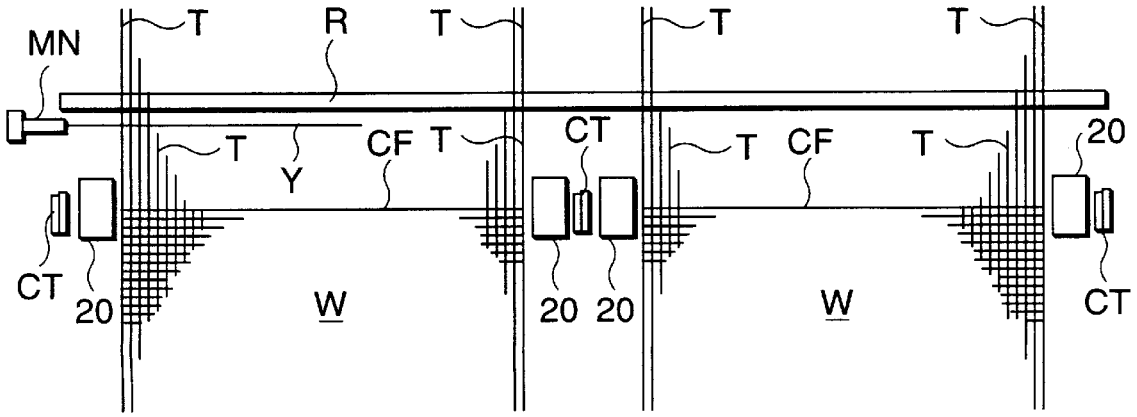
FIG. 12 is a plan view schematically showing an example shuttleless loom equipped with a tuck-in apparatus according to the present invention.

(vii) In a case where a tuck-in apparatus according to the present invention is disposed on a non-yarn-feeding side of a shuttleless loom or where a tuck-in apparatus is provided in the intermediate portion of a shuttleless loom capable of producing two woven fabrics simultaneously as shown in FIG. 12, a capturing hole may be omitted. This is because there is no need to cut an end portion of weft immediately before a tuck-in operation is performed, as contrasted with the case where a tuck-in apparatus is provided on a yarn-feeding side of a shuttleless loom.

The present disclosure relates to the subject matter contained in Japanese Patent application No. Hei.11-281434 filed on Oct. 1, 1999 which is expressly incorporated herein by reference in its entirety.

What is claimed is:

1. A tuck-in apparatus for a shuttleless loom, for blowing an end portion of a weft into a shed, comprising:

a plurality of nozzles located on a side of the row of warps for jetting air, said plurality of nozzles including:

a tuck-in nozzle located in the vicinity of a cloth fell and oriented in substantially parallel with the cloth fell; and at least one auxiliary tuck-in nozzle oriented by an acute angle toward a warp supply side with respect to the cloth fell.

2. The tuck-in apparatus according to claim 1, wherein said auxiliary tuck-in nozzle is arranged in the warp supply side with respect to said tuck-in nozzle.

3. The tuck-in apparatus according to claim 1, wherein said auxiliary tuck-in nozzle is oriented such as to avoid a jet direction thereof from intersecting a jet direction of said tuck-in nozzle at a jet side thereof.

4. The tuck-in apparatus according to claim 1, wherein said auxiliary tuck-in nozzles comprise at least two auxiliary tuck-in nozzles, and said at least two auxiliary tuck-in nozzles are oriented such as to avoid the jet directions thereof intersecting each other at a jet side thereof.

5. The tuck-in apparatus according to claim 4, wherein said at least two auxiliary tuck-in nozzles are oriented by the acute angles that are different from each other with respect to the cloth fell.

6. A tuck-in apparatus for a shuttleless loom, for blowing an end portion of a weft into a shed, comprising:

a plurality of nozzles located on a side of the row of warps for jetting air, said plurality of nozzles including:

a tuck-in nozzle located in the vicinity of a cloth fell and oriented by a first angle toward a warp supply side with respect to the cloth fell; and at least one auxiliary tuck-in nozzle oriented by a second angle toward the warp supply side with respect to the cloth fell, said second angle being not smaller than said first angle.

7. The tuck-in apparatus according to claim 6, wherein the first angle is set to be 0° so that said tuck-in nozzle is oriented in parallel with the cloth fell.

8. The tuck-in apparatus according to claim 6, wherein said auxiliary tuck-in nozzle is oriented such as to avoid a jet direction thereof from intersecting a jet direction of said tuck-in nozzle at a jet side thereof.

9. The tuck-in apparatus according to claim 6, wherein said auxiliary tuck-in nozzles comprise at least two auxiliary tuck-in nozzles, and said at least two auxiliary tuck-in nozzles are oriented such as to avoid the jet directions thereof from intersecting each other at a jet side thereof.

10. The tuck-in apparatus according to claim 9, wherein said at least two auxiliary tuck-in nozzles are directed by the acute angles that are different from each other with respect to the cloth fell.

11. The tuck-in apparatus according to claim 6, further comprising:

a main body with a substantially U-shaped slit formed in substantially parallel with a supply direction of the warp and opened toward the warp supply side.

12. The tuck-in apparatus according to claim 11, wherein said tuck-in nozzle comprises a pair of tuck-in nozzles disposed opposite to each other in such a manner as to interpose said slit, and said auxiliary tuck-in nozzle comprises a pair of auxiliary tuck-in nozzles disposed opposite to each other in such a manner as to interpose said slit.

13. The tuck-in apparatus according to claim 11, wherein a capturing hole disposed on a line extending from the cloth fell, for capturing the weft is formed in said slit.

14. The tuck-in apparatus according to claim 6, wherein said auxiliary tuck-in nozzle is arranged in the warp supply side with respect to said tuck-in nozzle.

15. A tuck-in method for a shuttleless loom, for blowing an end portion of a weft into a shed, comprising the steps of:

jetting air from a auxiliary tuck-in nozzle disposed on a side of the row of warps and oriented by an acute angle with respect to a cloth fell toward a warp supply side; and jetting air from a tuck-in nozzle disposed on the side of the row of warps and oriented in substantially parallel with the cloth fell.

16. The tuck-in method according to claim 15, wherein the jet of air from said auxiliary tuck-in nozzle precedes the jet of air from said tuck-in nozzle.

17. The tuck-in method according to claim 15, wherein at least two auxiliary tuck-in nozzles oriented by the acute angles which are different from each other with respect to the cloth fell are disposed on the side of the row of warps, and said auxiliary tuck-in nozzles jet air in sequence from said auxiliary tuck-in nozzle with a largest acute angle with respect to the cloth fell.

18. The tuck-in method according to claim 15, further comprising the step of:

capturing the end portion of the weft into a capturing hole disposed on a line extending from the cloth fell, before said jetting step of said auxiliary tuck-in nozzle.

19. The tuck-in method according to claim 18, further comprising the step of:

jetting air from a release nozzle disposed on a bottom portion of a slit toward the warp supply side to release the end portion of the weft from the capturing hole.

20. The tuck-in method according to claim 18, wherein the end portion of the weft captured in said capturing step is released from said capturing hole by the jetting of said auxiliary tuck-in nozzle.

* * * * *

UNITED STATES PATENT AND TRADEMARK OFFICE

CERTIFICATE OF CORRECTION

PATENT NO. : 6,240,976 B1 
DATED : June 5, 2001
INVENTOR(S) : Takeshi Satoh et al.

It is certified that error appears in the above-identified patent and that said Letters Patent is hereby corrected as shown below:

Column 10,
Line 29, “a auxiliary” should read -- an auxiliary --.
Line 36, “wherein” should read -- further comprising the step of: --.
Line 37, “the jet of” should read -- jetting --.
Lines 37-38, “precedes the jet of” should read -- before jetting --.
Line 39, “wherein” should read -- further comprising the steps of:
disposing on the side of the row of warps --.
Line 40, after “nozzles”, insert a comma: and “oriented by the” should read -- orienting said nozzles by --.
Line 42, after “fell”, insert a comma; and delete “are disposed on the side of the row of warps,”.
Line 44, “said auxiliary tuck-in nozzles jet” should read -- jetting --.
Line 45, “with a largest” should read -- with the largest --.
Line 58, “wherein” should read -- further comprising the step of: --.
Line 59, before “the end portion”, insert -- releasing --.
Lines 59-60, delete “is released”.
Line 60, “the jetting of” should read -- jetting air from --.

Signed and Sealed this

Thirteenth Day of August, 2002

*Attest:*

*Attesting Officer*

JAMES E. ROGAN
*Director of the United States Patent and Trademark Office*